US007682431B1

(12) United States Patent
Zieliene et al.

(10) Patent No.: US 7,682,431 B1
(45) Date of Patent: Mar. 23, 2010

(54) PLATING SOLUTIONS FOR ELECTROLESS DEPOSITION OF RUTHENIUM

(75) Inventors: Albina Zieliene, Vilnius (LT); Algirdas Vaskelis, Vilnius (LT); Eugenijus Norkus, Vilnius (LT)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 12/269,857

(22) Filed: Nov. 12, 2008

(51) Int. Cl.
*C23C 18/44* (2006.01)

(52) U.S. Cl. ..... 106/1.24; 106/1.28

(58) Field of Classification Search ..... 106/1.24, 106/1.28
See application file for complete search history.

(56) References Cited

U.S. PATENT DOCUMENTS 3,530,049 A * 9/1970 Scherzer et al. ..... 106/1.24
5,203,911 A * 4/1993 Sricharoenchaikit et al. ..... 106/1.26
5,562,760 A * 10/1996 Ballard et al. ..... 106/1.24
6,120,639 A * 9/2000 Redline et al. ..... 427/99.5
7,041,606 B2 * 5/2006 Klein ..... 438/758
7,291,513 B2 * 11/2007 Ouellet et al. ..... 438/64
2006/0220080 A1 * 10/2006 Dubin et al. ..... 257/295
2006/0278123 A1 * 12/2006 Wirth ..... 106/1.22

* cited by examiner

*Primary Examiner*—Helene Klemanski
(74) *Attorney, Agent, or Firm*—Martine Penilla & Gencarella, LLP

(57) ABSTRACT

An electroless ruthenium plating solution is disclosed herein. The solution includes a ruthenium source, a polyamino polycarboxylic acid complexing agent, a reducing agent, a stabilizing agent, and a pH-modifying substance. A method of preparing an electroless ruthenium plating solution is also provided.

18 Claims, 7 Drawing Sheets

Kinetics of electroless deposition on copper electrode (a, frequency change rate; b, change in frequency). Composition of the solution (g/l): $(RuNO)_2(SO_4)_3$ – 2.75, $(NH_2OH)_2$ $H_2SO_4$ – 0.61, NaOH – 40, CDTA – 9.1, $NaBH_4$ – 2; 40 °C. Loading = 0.2 $cm^2$/2 ml.

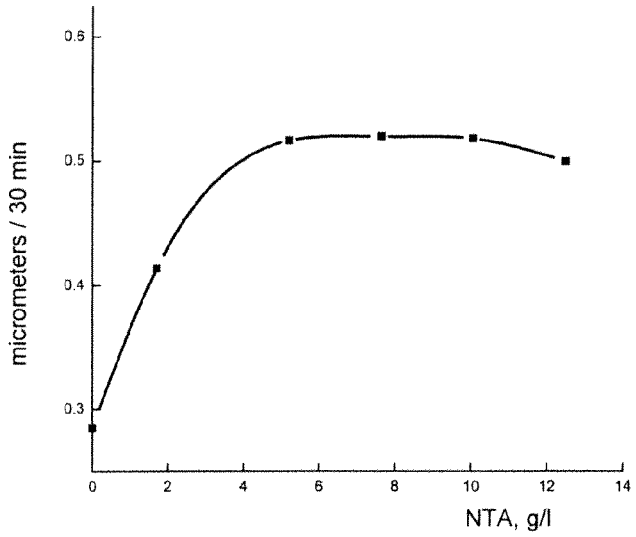
Fig. 1. Dependence of Ru deposition rate on the concentration of NTA. Composition of the solution (g/l): $(RuNO)_2(SO_4)_3$ – 2.75, $(NH_2OH)_2 \cdot H_2SO_4$ – 0.61, NaOH – 40, $NaBH_4$ – 2; 35 °C. Loading = 2 $cm^2$/2 ml.

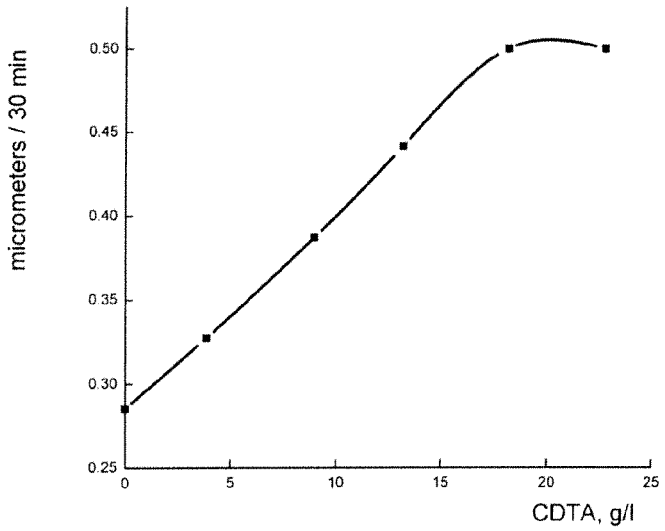
Fig. 2. Dependence of Ru deposition rate on the concentration of CDTA. Composition of the solution (g/l): $(RuNO)_2(SO_4)_3$ – 2.75, $(NH_2OH)_2 \cdot H_2SO_4$ – 0.61, NaOH – 40, $NaBH_4$ – 2; 35 °C. Loading = 2 $cm^2$/2 ml.

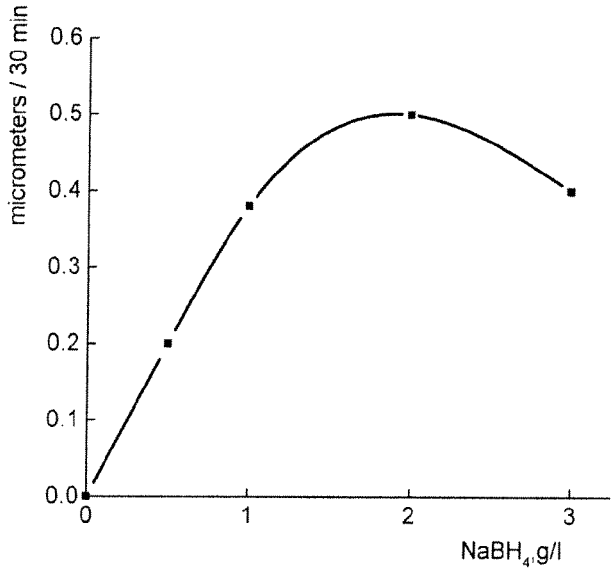
Fig. 3. Dependence of Ru deposition rate on the concentration of $NaBH_4$. Composition of the solution (g/l): $(RuNO)_2(SO_4)_3$ – 2.75, $(NH_2OH)_2 \cdot H_2SO_4$ – 0.61, NaOH – 40, CDTA – 18.2; 35 °C. Loading = 2 $cm^2$/2 ml.

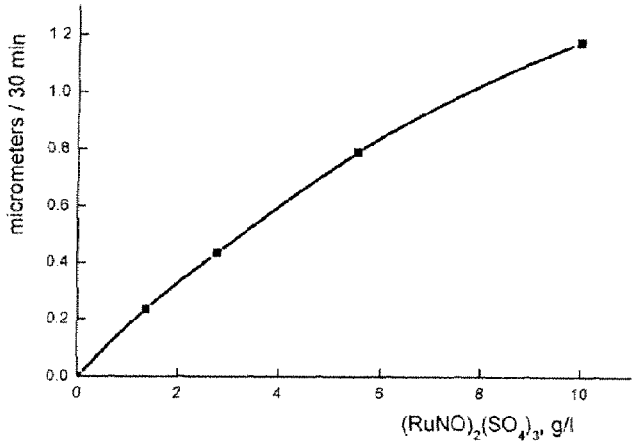
Fig. 4. Dependence of Ru deposition rate on the concentration of $(RuNO)_2(SO_4)_3$. Composition of the solution (g/l): CDTA – 9.1, $(NH_2OH)_2 \cdot H_2SO_4$ – 0.61, NaOH – 40, $NaBH_4$ – 2; 35 °C. Loading = 2 $cm^2$/2 ml.

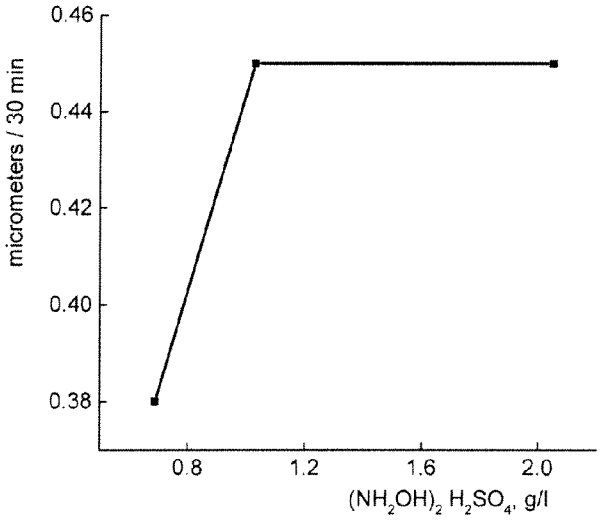
Fig. 5. Dependence of Ru deposition rate on the concentration of $(NH_2OH)_2 \cdot H_2SO_4$. Composition of the solution (g/l): $(RuNO)_2(SO_4)_3$ – 2.75, CDTA – 9.1, NaOH – 40, $NaBH_4$ – 2; 35 °C. Loading = 2 $cm^2$/2 ml.

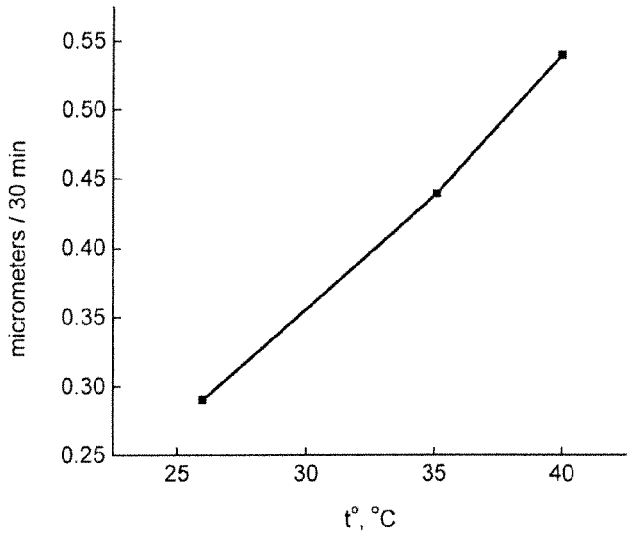
Fig. 6. Dependence of Ru deposition rate on the solution temperature. Composition of the solution (g/l): $(RuNO)_2(SO_4)_3$ – 2.75, CDTA – 9.1, $NH_2OH)_2 \cdot H_2SO_4$ – 1, NaOH – 40, $NaBH_4$ – 2. Loading = 2 $cm^2$/2 ml.

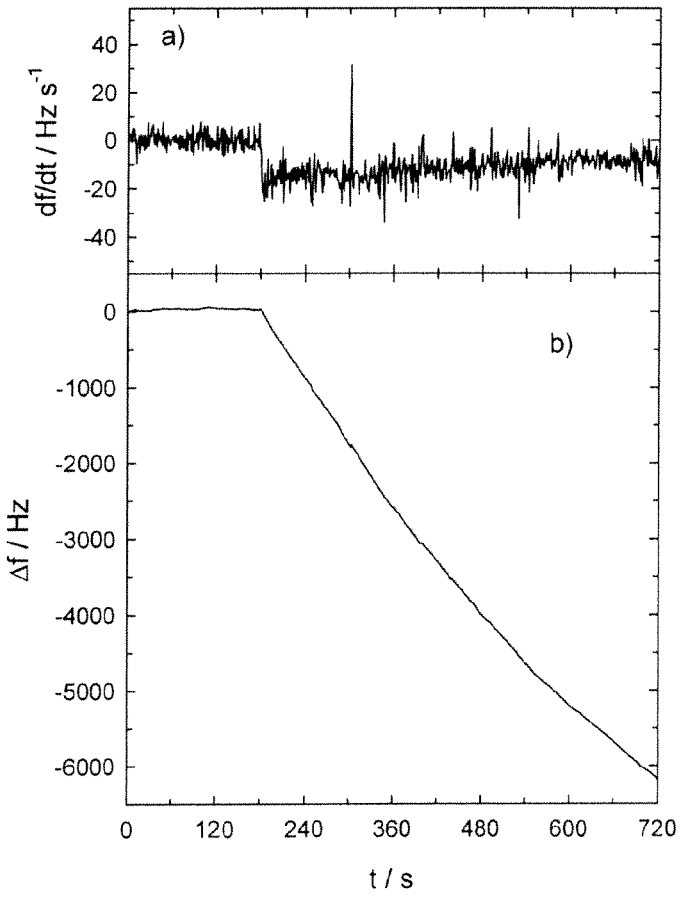
Fig. 7. Kinetics of electroless deposition on copper electrode (a, frequency change rate; b, change in frequency). Composition of the solution (g/l): $(RuNO)_2(SO_4)_3$ – 2.75, $(NH_2OH)_2$ $H_2SO_4$ – 0.61, NaOH – 40, CDTA – 9.1, $NaBH_4$ – 2; 40 °C. Loading = 0.2 $cm^2$/2 ml.

PLATING SOLUTIONS FOR ELECTROLESS DEPOSITION OF RUTHENIUM

BACKGROUND

The fabrication of semiconductor devices such as integrated circuits, memory cells, and the like, involve a series of manufacturing operations that are performed to define features on semiconductor wafers ("wafers"). The wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

To build an integrated circuit, transistors are first created on the surface of the wafer. The wiring and insulating structures are then added as multiple thin-film layers through a series of manufacturing process steps. Typically, a first layer of dielectric (insulating) material is deposited on top of the formed transistors. Subsequent layers of metal (e.g., copper, aluminum, etc.) are formed on top of this base layer, etched to create the conductive lines that carry the electricity, and then filled with dielectric material to create the necessary insulators between the lines. The process used for producing copper lines is referred to as a dual Damascene process, where trenches are formed in a planar conformal dielectric layer, vias are formed in the trenches to open a contact to the underlying metal layer previously formed, and copper is deposited everywhere. Copper is then planarized (overburden removed), leaving copper in the vias and trenches only.

When copper materials are used metal barrier layers are need to prevent the copper from diffusing into the interlayer dielectric (ILD) layer. The diffusion of the copper into the ILD is sometimes referred to as poisoning of the ILD. The material for the metal barriers forms excellent barriers to copper diffusion. In addition, the manufacturers of semiconductor devices are investigating materials for use as capping layers to prevent the oxidation of layers disposed below the capping layers.

It is within this context that the embodiments arise.

SUMMARY

Broadly speaking, the present invention fills these needs by providing improved formulations of electroless deposition of ruthenium. It should be appreciated that the present invention can be implemented in numerous ways, including as a method and a chemical solution. Several inventive embodiments of the present invention are described below.

In one exemplary embodiment, an electroless ruthenium plating solution is disclosed. The solution includes a ruthenium source, a polyamino polycarboxylic acid complexing agent, a reducing agent, a stabilizing agent, and a pH-modifying substance. The polyamino polycarboxylic acid may be nitrilotriacetic acid (NTA), trans-cyclohexane 1,2-diamine tetraacetic acid (CDTA), or ethylenediaminetetraacetic acid (EDTA). In one embodiment, the solution is ammonia free.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIG. 1 is a graphical illustration of the dependence of the ruthenium deposition rate on the concentration of NTA in accordance with one embodiment of the invention.

FIG. 2 is a graphical illustration the dependence of the ruthenium deposition rate on the concentration of CDTA in accordance with one embodiment of the invention.

FIG. 3 is a graphical illustration of the dependence of the ruthenium deposition rate according to the concentration of the sodium borohydride in accordance with one embodiment of the invention.

FIG. 4 is a graphical illustration of the dependence of the ruthenium deposition rate on the concentration of the ruthenium source in accordance with one embodiment of the invention.

FIG. 5 is a graphical illustration of the dependence of the ruthenium deposition rate on the concentration of the stabilizing agent in accordance with one embodiment of the invention.

FIG. 6 is a graphical illustration of the dependence of the ruthenium deposition rate on the solution temperature in accordance with one embodiment of the invention.

FIG. 7 is a graphical illustration of the kinetics of the electroless deposition using the plating solution described herein on a copper electrode in accordance with one embodiment of the invention.

DETAILED DESCRIPTION

An invention is described for providing formulations of electroless ruthenium solutions for use in electroless deposition processes. It will be obvious, however, to one skilled in the art, that the present invention may be practiced without some or all of these specific details. In other instances, well known process operations have not been described in detail in order not to unnecessarily obscure the present invention.

Electroless metal deposition processes used in semiconductor manufacturing applications are based upon simple electron transfer concepts. The processes involve placing a prepared semiconductor wafer into an electroless metal plating solution bath then inducing the metal ions to accept electrons from a reducing agent resulting in the deposition of the reduced metal onto the surface of the wafer. The success of the electroless metal deposition process is highly dependent upon the various physical (e.g., temperature, etc.) and chemical (e.g., pH, reagents, etc.) parameters of the plating solution. As used herein, a reducing agent is an element or compound in an oxidation-reduction reaction that reduces another compound or element. In doing so, the reducing agent becomes oxidized. That is, the reducing agent is an electron donor that donates an electron to the compound or element being reduced.

A complexing agent (i.e., chelators or chelating agent) is any chemical agent that can be utilized to reversibly bind to compounds and elements to form a complex. A salt is any ionic compound composed of positively charged cations (e.g., Ru+, etc.) and negatively charged anions, so that the product is neutral and without a net charge. A simple salt is any salt species that contain only one kind of positive ion (other than the hydrogen ion in acid salts). A complex salt is any salt species that contains a complex ion that is made up of a metallic ion attached to one or more electron-donating molecules. Typically a complex ion consists of a metallic atom or ion to which is attached one or more electron-donating molecules (e.g., (Ru)ethylenediamine-2+, etc.). A protonized compound is one that has accepted a hydrogen ion (i.e., H+) to form a compound with a net positive charge.

In some embodiments, it may be preferable to have a liner layer deposited over a barrier layer in order to provide a smooth surface for further copper plating. The embodiments described below provide for the electroless ruthenium plating on copper. In addition, the ruthenium film deposited herein may provide for a capping layer, to prevent oxidation of layers disposed below.

It should be appreciated that the embodiments further provide for the ruthenium film deposition without etching copper below. Tables 1 through 4 illustrate the four different solutions described herein. FIGS. 1 through 7 illustrate various graphs showing the effect of the different parameters for the different formulations described herein for informational purposes. In FIG. 1, the dependence of the ruthenium deposition rate on the concentration of NTA is illustrated in accordance with one embodiment of the invention. FIG. 2 is a graph illustrating the dependence of the ruthenium deposition rate on the concentration of CDTA in accordance with one embodiment of the invention. FIG. 3 is a graph illustrating the dependence of the ruthenium deposition rate according to the concentration of the sodium borohydride in accordance with one embodiment of the invention. FIG. 4 is a graph illustrating the dependence of the ruthenium deposition rate on the concentration of the ruthenium source in accordance with one embodiment of the invention. FIG. 5 is a graph illustrating the dependence of ruthenium deposition rate on the concentration of the stabilizing agent in accordance with one embodiment of the invention. FIG. 6 is a simplified graph illustrating the dependence of the ruthenium deposition rate on the solution temperature in accordance with one embodiment of the invention. FIG. 7 is a graphical illustration of the kinetics of the electroless deposition on a copper electrode in accordance with one embodiment of the invention.

Described below in Tables 1-4 are four possible formulations for use with electroless plating for ruthenium on a copper surface. In the embodiments for the exemplary plating solutions described below, polyamino polycarboxylic acids may be used as complexing agents for formulations of electroless ruthenium deposition. It should be noted that the complexing agents may be referred to as chelators or ligands also. In one embodiment, nitrilotriacetic acid (NTA) is the polyamino polycarboxylic acid. In another embodiment, trans-cyclohexane 1,2-diamine tetraacetic acid (CDTA) is utilized as the polyamino polycarboxylic acid. In yet another embodiment, ethylenediaminetetraacetic acid with or without ammonia is utilized as the complexing agent. In the embodiments, the use of certain chelators/complexing agents/ligands allows performing the electroless ruthenium plating process at temperatures lower than 50 degrees C., e.g., under ambient conditions. One skilled in the art will appreciate that the quantities of the components of the formulations may be varied from the specific examples provided.

TABLE 1

| | |
|---|---|
| $(RuNO)_2(SO_4)_3$ | 5.5 g/L |
| NaOH | 40 g/L |
| $NH_3$ (25%) | 200 mL/L |
| $(NH_2OH)_2H_2SO_4$ | 0.5 g/L |
| $NaBH_4$ | 1-2 g/L |

TABLE 2

| | |
|---|---|
| $(RuNO)_2(SO_4)_3$ | 5.5 g/L |
| NaOH | 40 g/L |
| $NH_3$ | 200 ml/L |
| Disodium salt of EDTA $2H_2O$ | 17 g/L |
| $(NH_2OH)_2H_2SO_4$ | 0.5 g/L |
| $NaBH_4$ | 1-2 g/L |

TABLE 3

| | |
|---|---|
| $(RuNO)_2$ | 5.5 g/L |
| NaOH | 40 g/L |
| NTA | 10 g/L |
| $(NH_2OH)_2H_2SO_4$ | 1 g/L |
| $NaBH_4$ | 2 g/L |

TABLE 4

| | |
|---|---|
| $(RuNO)_2(SO_4)_3$ | 5.5 g/L |
| NaOH | 40 g/L |
| CDTA | 18.2 g/L |
| $(NH_2OH)_2H_2SO_4$ | 1 g/L |
| $NaBH_4$ | 2 g/L |

In one exemplary embodiment, the solution is prepared by dissolving the ruthenium source, e.g., $(RuNO)_2(SO_4)_3$, in a sodium hydroxide solution. One exemplary amount includes dissolving about 5.5 grams per liter of the ruthenium source material in 40 grams per liter of a sodium hydroxide solution. Next, the hydroxylamine hydrosulphate $(NH_2OH)_2H2SO_4$ (which functions as a stabilizing agent) is added at about 1 gram per liter. Depending on the solution formulation, NTA, CDTA, ammonia ($NH_3$), or ammonia with EDTA may be utilized as the complexing agent. The solution is then heated to 35-70 degrees C., and sodium borohydride ($NaBH_4$) is added. In one embodiment, the sodium borohydride is dissolved in the sodium hydroxide prior to addition and these two components are added at the end. In the embodiments, a lower temperature is used for the plating with the NTA and CDTA formulations. In addition, the ammonia formulation with EDTA utilizes a lower temperature than the formulation with ammonia only.

Two types of substrates to be plated were used with the electroless plating solutions described herein. The two types of substrates included: 1) an untreated blanket Silicon wafer with a sputtered PVD TaN/Ta barrier and Cu seed or 2) copper foil, pre-treated with Vienna lime (calcium carbonate) and acid solution and then rinsed with water. After the plating procedure, the plated wafer or plated copper foil were used for determination of mass of deposited coating from the difference in weight before and after plating. The mass increase was used for recalculations and plating rate is presented in μm in 30 min (the density of ruthenium coating was taken equal to 12.0 g $cm^{-3}$). Electroless ruthenium plating was carried out for 30 minutes. The loading (surface area of substrate to be plated per volume of plating solution) was about 1 $cm^2$/ml.

The embodiments disclose commercially available polyamino polycarboxylic acids used as complexing agents for formulations of electroless ruthenium deposition, namely NTA (nitrilotriacetic acid) and CDTA (trans-cyclohexane-1, 2-diaminetetraacetic acid). The use of mentioned chelators allows performing the electroless ruthenium plating process at temperatures lower than 50° C., e.g., at 35-40° C. or even ambient temperature.

FIG. 1 is a graphical illustration of the dependence of the ruthenium deposition rate on the concentration of NTA in accordance with one embodiment of the invention. Addition of 5-10 g/L of NTA to the electroless ruthenium plating increases the plating rate practically twice, comparing with a solution without NTA, e.g., solely ammonia, and allows to obtain coatings with thickness of 0.5 μm in 30 min. Composition of the solution for FIG. 1 was as follows where all units are in (g/l): $(RuNO)_2(SO_4)_3$–2.75, $(NH_2OH)_2.H_2SO_4$–0.61, NaOH–40, $NaBH_4$–2; 35° C. and loading=2 $cm^2$/2 ml.

FIG. 2 is a graphical illustration the dependence of the ruthenium deposition rate on the concentration of CDTA in accordance with one embodiment of the invention. In the case of CDTA, higher concentrations of CDTA are needed to obtain the highest plating rates, i.e., the rate of 0.5 μm in 30 min (comparable to the highest rate using NTA) is reached using 18 g/L of CDTA). Composition of the solution for FIG. 2 was as follows where all units are in (g/l): $(RuNO)_2(SO_4)_3$–2.75, $(NH_2OH)_2.H_2SO_4$–0.61, NaOH–40, $NaBH_4$–2; 35° C. and loading=2 $cm^2$/2 ml.

FIG. 3 is a graphical illustration of the dependence of the ruthenium deposition rate according to the concentration of the sodium borohydride in accordance with one embodiment of the invention. The electroless ruthenium plating rate increases with a corresponding increase in the concentration of reducing agent ($NaBH_4$). The maximum value of the plating rate occurs at a concentration of $NaBH_4$ equal to about 2 g/L, and later decreases. It should be noted that the concentration of 2 g/L of $NaBH_4$ is optimal, since solutions containing higher concentrations of reducing agent become unstable after 20-30 min and ruthenium reduction is observed in solution bulk. Composition of the solution for FIG. 3 was as follows where all units are in (g/l): $(RuNO)_2(SO_4)_3$–2.75, $(NH_2OH)_2.H_2SO_4$–0.61, NaOH–40, CDTA–18.2; 35° C. and loading=2 $cm^2$/2 ml.

FIG. 4 is a graphical illustration of the dependence of the ruthenium deposition rate on the concentration of the ruthenium source in accordance with one embodiment of the invention. The increase in ruthenium source ($(RuNO)_2(SO_4)_3$) concentration results in substantial increase in the electroless ruthenium plating rate and at a concentration of 10 g/L of $(RuNO)_2(SO_4)_3$ up to a 1.2 μm thick ruthenium coating was deposited. The plating solutions are stable for at least 30 min. Only in the case of using of highest investigated ruthenium salt concentration (10 g/L), ruthenium reduction was observed earlier than 30 min., i.e., after 27 min. Composition of the solution for FIG. 4 was as follows where all units are in (g/l): CDTA–9.1, $(NH_2OH)_2.H_2SO_4$–0.61, NaOH–40, $NaBH_4$–2; 35° C. Loading=2 $cm^2$/2 ml.

FIG. 5 is a graphical illustration of the dependence of the ruthenium deposition rate on the concentration of the stabilizing agent in accordance with one embodiment of the invention. Hydroxylamine hydrosulphate is used in electroless ruthenium plating solutions as stabilizing agent, and generally diminishes ruthenium deposition rate in solutions containing polyamino polycarboxylic acids as the complexing agent. Rather unexpected results were obtained using CDTA as the complexing agent and the hydroxylamine hydrosulphate as the stabilizing agent. When increasing the concentration of hydroxylamine hydrosulphate higher from 0.6 g/L to about 1 g/L, the plating rate raises over 10%. In addition, no diminution of the plating rate is observed at the higher concentration of hydroxylamine hydrosulphate up to 2 g/L. Therefore, the concentration of hydroxylamine hydrosulphate can be maintained at 1 gram per liter in this embodiment. Composition of the solution for FIG. 5 was as follows where all units are in (g/l): $(RuNO)_2(SO_4)_3$–2.75, CDTA–9.1, NaOH–40, $NaBH_4$–2; 35° C. and loading=2 $cm^2$/2 ml.

The data of FIG. 6 illustrate the possibility of obtaining of electroless ruthenium coatings at practically ambient conditions exists. The plating rate at 26° C. is about 0.3 μm in 30 min. The elevation of temperature increases the plating rate accordingly. Composition of the solution for FIG. 6 was as follows where all units are in (g/l): $(RuNO)_2(SO_4)_3$–2.75, CDTA–9.1, $NH_2OH)_2.H_2SO_4$–1, NaOH–40, $NaBH_4$–2. and loading=2 $cm^2$/2 ml.

It can be added that the induction period depends strongly on temperature of solutions used. At 35° C. the induction period is about 2-3 min, and decreased with the elevation of temperature. The induction period could be shortened also by means of pre-activation of Cu surface in an alkaline solution of $NaBH_4$.

In FIG. 7, the data of Electrochemical Quartz Crystal Microgravimetry (EQCM) on a copper plated quartz resonator allows observing the duration of induction period as well as the instantaneous electroless ruthenium plating rate is illustrated. It can be noted, that in EQCM experiments the loading was ten times lower than in above described experiments, therefore the induction period determined was rather long—about 3 min in the lower portion of the graph of FIG. 7. After 3 minutes the electroless ruthenium deposition on copper starts and proceeds with a practically constant rate). The previously made calibration gave that the decrease in quartz resonator frequency equal to 1000 Hz corresponds to mass decrease equal to 1.092 μg. Consequently, when electroless ruthenium deposition proceeds (after induction period), 3.5 nm of ruthenium coating are obtained in 1 min. It is worthy to note, that the induction period depends on loading. At 40° C., when loading was 0.2 $cm^2$/2 ml, induction period was 3 min, whereas after elevation of loading up to 2 $cm^2$/2 ml, the induction period decreased up to 1 min.

Although a few embodiments of the present invention have been described in detail herein, it should be understood, by those of ordinary skill, that the present invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims.

What is claimed is:

1. An electroless ruthenium plating solution, comprising:

a ruthenium source;

a polyamino polycarboxylic acid complexing agent;

a reducing agent;

hydroxylamine hydrosulphate ($(NH_2OH)_2H_2SO_4$), which functions as a stabilizing agent; and a pH-modifying substance.

2. The electroless ruthenium plating solution, as recited in claim 1, wherein, the ruthenium source is $(RuNO)_2(SO_4)_3$.

3. The electroless ruthenium plating solution, as recited in claim 1, wherein the complexing agent is selected from the group consisting of nitrilotriacetic acid (NTA), trans-cyclohexane-1,2-diamine tetraacetic acid (CDTA), and ethylenediaminetetraacetic acid (EDTA).

4. The electroless ruthenium plating solution, as recited in claim 1, wherein, the reducing agent is $NaBH_4$.

5. The electroless ruthenium plating solution, as recited in claim 1, wherein, the pH modifying substance is sodium hydroxide.

6. The electroless ruthenium plating solution, as recited in claim 1, wherein the complexing agent is a mixture of EDTA and ammonia.

7. The electroless ruthenium plating solution, as recited in claim 1, wherein the ruthenium source is ruthenium salt.

8. The electroless ruthenium plating solution, as recited in claim 1, wherein a concentration of the ruthenium source in the solution is between about 5 g/L and about 10 g/L.

9. The electroless ruthenium plating solution, as recited in claim 1, wherein a concentration of the reducing agent in the solution is between about 1 g/L and about 2 g/L.

10. The electroless ruthenium plating solution, as recited in claim 1, wherein a concentration of the ruthenium source is about 5.5 g/L.

11. The electroless ruthenium plating solution, as recited in claim 1, wherein a concentration of the polyamino polycarboxylic acid complexing agent is between about 10 g/L and about 20 g/L.

12. The electroless ruthenium plating solution, as recited in claim 1, wherein a concentration of the stabilizing agent is between about 0.5 and about 2 g/L.

13. The electroless ruthenium plating solution, as recited in claim 1, wherein a concentration of the pH modifying substance is about 40 g/L.

14. An electroless ruthenium plating solution, comprising:

a ruthenium source;

a polyamino polycarboxylic acid complexing agent consisting essentially of one of nitrilotriacetic acid (NTA) or trans-cyclohexane-1,2-diamine tetraacetic acid (CDTA);

$NaBH_4$ as a reducing agent;

a stabilizing agent; and a pH-modifying substance.

15. The solution of claim 14, wherein the stabilizing agent is hydroxylamine hydrosulphate ($(NH_2OH)_2H_2SO_4$)).

16. The solution of claim 14, wherein the ruthenium source is ruthenium salt and wherein the pH modifying substance is a base.

17. An electroless ruthenium plating solution, comprising:

$(RuNO)_2(SO_4)_3$ as a ruthenium source;

a polyamino polycarboxylic acid complexing agent;

a reducing agent;

a stabilizing agent; and a pH-modifying substance.

18. The solution of claim 17, wherein the stabilizing agent is hydroxylamine hydrosulphate $(H_2OH)_2H_2SO_4$) and wherein the reducing agent is $NaBH_4$.

* * * * *